United States Patent [19]

Brown et al.

[11] Patent Number: 4,607,311

[45] Date of Patent: Aug. 19, 1986

[54] POWER CIRCUIT FOR ELECTROMAGNETIC ACTUATOR

[75] Inventors: Robert H. Brown, Kingston-on-Thames; Peter V. Comrie, Greenford, both of England

[73] Assignee: Lucas Industries public limited company, Birmingham, England

[21] Appl. No.: 502,168

[22] Filed: Jun. 8, 1983

[30] Foreign Application Priority Data

Jul. 10, 1982 [GB] United Kingdom ..... 8220121

[51] Int. Cl.[4] ..... F02D 41/30; H01H 47/32

[52] U.S. Cl. ..... 361/155; 123/490

[58] Field of Search ..... 361/155, 154, 152; 307/75; 123/490; 323/266, 271, 288

[56] References Cited

U.S. PATENT DOCUMENTS 4,454,558 6/1984 Huddart ..... 361/155

FOREIGN PATENT DOCUMENTS 262218 1/1971 U.S.S.R. ..... 307/75

*Primary Examiner*—Michael L. Gellner

[57] ABSTRACT

A power supply circuit for an electromagnetic actuator includes a first capacitor and a charging circuit for charging the first capacitor from a second capacitor. A unidirectional switch is operable to discharge the first capacitor into the actuator winding. A second unidirectional switch is operable to provide holding current from a low voltage source of supply to maintain the winding energized. A diode provides energy recovery when the actuator is de-energized.

4 Claims, 3 Drawing Figures

POWER CIRCUIT FOR ELECTROMAGNETIC ACTUATOR

This invention relates to a power supply circuit for an electromagnetic actuator and of the kind in which a charged capacitor is discharged into the winding of the actuator to achieve a rapid rise of current therein and therefore rapid operation of the actuator.

With such an arrangement it is often necessary to maintain a holding current in the actuator winding so that the actuator is maintained in its operating condition.

The object of the present invention is to provide a power supply circuit of the kind specified in a simple and convenient form.

According to the invention a power supply circuit for an electromagnetic actuator comprises a first capacitor constituting said charged capacitor, a second capacitor, means for charging said second capacitor from a source of electric supply, a charging circuit through which said first capacitor can be charged from second capacitor, a first unidirectional switch means which when closed connects the actuator in circuit with said first capacitor thereby to cause a high initial current flow in the winding of the actuator, a lower voltage source of supply, and a second unidirectional switch means operable to connect said low voltage source of supply in circuit with said winding, said second unidirectional switch means being operable to deliver a holding current into the winding when said first capacitor has discharged to approximately the voltage of said low voltage source.

Examples of power supply circuits in accordance with the invention will now be described with reference to the accompanying drawings in which.

The power supply circuits to be described are intended for use in a fuel system for an internal combustion engine in which electromagnetic actuators are utilised to initiate injection of fuel to an associated engine. The actuators must be operated in timed relationship with the engine and there is provided a governor circuit which provides the necessary control pulses to various components of the circuit as will be described.

Figure 1:
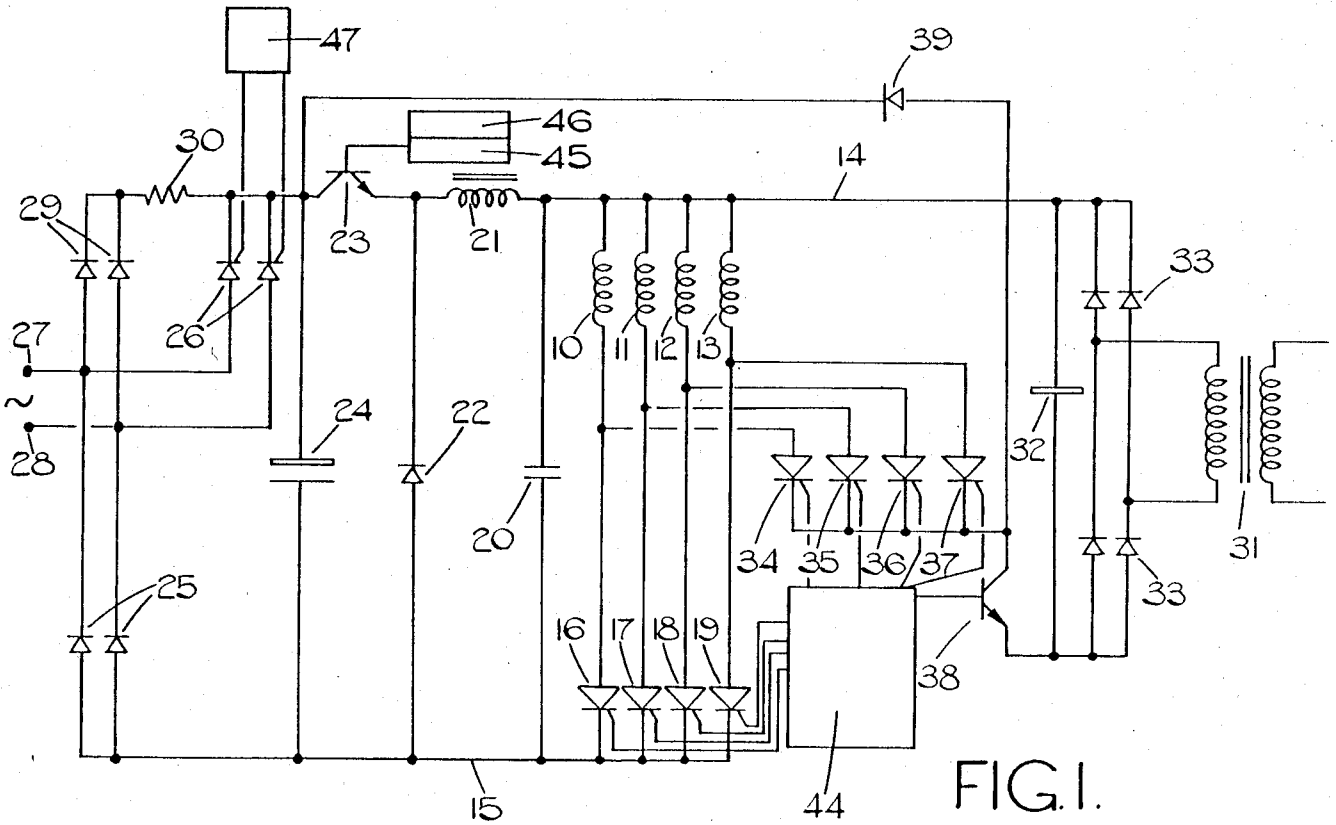
FIG. 1 is a circuit diagram showing the main components of one example of the power supply.

Referring now to FIG. 1 of the drawings, four electromagnetic actuators are indicated and are referenced 10, 11, 12 and 13 and each winding is directly connected to a supply line 14 and to a supply line 15 by way of thyristors 16, 17, 18 and 19 respectively. In use, the supply line 15 is at a negative potential and therefore the cathodes of the thyristors are connected to this line.

Connected between the supply lines 14 and 15 is a first capacitor 20, which as will be described, is charged in use, to a predetermined voltage level. When it is required to energise one of the actuators, the appropriate thyristor is fired and this results in the capacitor 20 discharging into the actuator and because the capacitor is charged to a high voltage, the rate of rise of current in the actuator is high, so that rapid operation of the actuator is obtained.

The capacitor 20 is charged by way of a "chopper" circuit including an inductor 21, a diode 22 and a transistor 23. The anode of the diode 22 is connected to the supply line 15 while the cathode is connected to the junction of one end of the winding of the inductor 21 and the emitter of the transistor 23. The other end of the winding of the inductor is connected to the supply line 14, whilst the collector of the transistor 23 is connected to one plate of a second capacitor 24 the other plate of which is connected to the supply line 15. The capacitor 24 constitutes a source of charge for the capacitor 20 and it is charged by way of a fullwave rectifier circuit comprising diodes 25, and thyristors 26, from a source of a.c. supply connected to supply terminals 27, 28, the source of supply conveniently being mains supply at 240 V. Since the capacitor 24 has a high value, a further pair of diodes 29, which are connected through a resistor 30 to the aforesaid one plate of the capacitor 24, are utilised to effect initial charging of the capacitor, the thyristors 26 being rendered conductive when the voltage across the capacitor 24 has achieved a predetermined value.

Considering the operation of the circuit thus far described and assuming that the capacitor 24 has been charged to the peak value of the mains voltage, the transistor 23 is turned on and current flows into the capacitor 20 to charge same, this current flowing by way of the inductor 21. The value of the charging current is monitored and when it achieves a predetermined level transistor 23 is turned off. When transistor 23 is turned off, the flux in the core of the inductor 21 collapses and the capacitor 20 is further charged by way of the diode 22. This process is repeated until capacitor 20 has been charged to a predetermined voltage and it is convenient to modify the current levels at which the transistor 23 is switched as the capacitor voltage rises to the desired level. This is in order to reduce the amount of energy stored in the core of the inductor at the end of the charging operation. When charging is complete transistor 23 is turned off and as previously mentioned, in order to discharge the capacitor 20 into an actuator, the respective thyristor 16, 17, 18 or 19 is fired. Clearly as the capacitor discharges into the actuator the voltage across the capacitor will fall. Nevertheless, the rate of increase of current in the actuator is high so that rapid operation of the actuator is achieved. During the time that the thyristor associated with the energised actuator is fired, transistor 23 is maintained in a non-conducting state. This allows time for the capacitor 24 to recharge, and it also prevents further charging of the capacitor 20 and as will be seen, it allows the respective thyristor 16–19 to turn off.

In order to provide a holding current, the further portion of the circuit is provided. The source of supply for the holding circuit comprises a transformer 31 the primary winding of which is connected to the terminals 27, 28. The secondary winding of the transformer is arranged to charge a capacitor 32 by way of a fullwave rectifier circuit including diodes 33 connected in the usual fashion. The supply line 14 extends to this circuit and a further set of thyristors 34, 35, 36 and 37 have their anodes connected to the anodes respectively of the first-mentioned set of thyristors. The cathodes of the further set of thyristors are connected by way of the collector emitter path of a transistor 38, to the negative line of the power circuit and the collector of the transistor 38 is connected to the anode of a diode 39, the cathode of which is connected to the aforesaid one plate of the capacitor 24.

In operation, the respective one of the thyristors 34–37, is fired at substantially the same time as the respective one of the thyristors 16–19. Moreover, the transistor 38 is rendered conductive at this time. The capacitor 32 is charged to a lower voltage than that of the capacitor 20 and as the latter discharges into an actuator, a point of time will be reached at which the voltage across the capacitor 20 is substantially equal to that across the capacitor 32. When this occurs the flow of current into the energised actuator takes place through the respective thyristor 34-37 and the transistor 38, and the previously fired thyristor 16-19 becomes non-conductive. The flow of current in this fashion can continue so long as it is required to maintain the actuator in the energised state. When it is required to de-energise the actuator, the transistor 38 is rendered non-conductive and the energy stored in the actuator winding passes by way of the respective one of the thyristors 34, 37 and the diode 39 to the capacitors 24 and 20, in series. The capacitor 24 is of course at a high voltage but in the discharge circuit as mentioned above, the voltage on the capacitor 20 opposes the voltage on the capacitor 24 and the practical effect is that the standing voltage on the capacitor 20 is reduced and energy transfer takes place to capacitor 24. The current decay in the actuator is extremely rapid. When the current decays the appropriate one of the thyristors 34, 37 becomes non-conductive. The cycle can then be repeated, the first stage being to recharge the capacitor 20 to the desired voltage.

As described the circuit dissipates very little power by way of heat and therefore it can be accommodated within a case of relatively small size. It is capable of ensuring that capacitor 20 is recharged to the required voltage in the short intervals of time which exist between the de-energisation of one electromagnetic device and the energisation of a further device.

The circuit as described however is susceptible to variation in the volage of the mains power supply. If the voltage of the supply falls then clearly the voltage across the capacitor 24 will fall and it may not be possible to charge the capacitor 20 to the required voltage. This could be overcome by incorporating into the design a constant voltage transformer, but such a transformer is bulky and expensive. An alternative arrangement would be to use a switched mode power supply but this would result in a loss of energy in the form of heat. It is proposed therefore that an auto-transformer should be provided. This will mean that the components in the chopper circuit will need to operate at a higher voltage but this can be alleviated by automatic tap changing.

The voltage of the supply circuit for the holding current is much more critical. However, the power requirements are also less and hence the transformer 31 can be replaced by a constant voltage transformer.

It is essential however that capacitor 24 should be held at a substantially constant voltage since as described, the voltage across the capacitor 24 influences the rate of decay of current in the winding of an actuator when the transistor 38 is rendered nonconductive. The problem with the capacitor 24 is overcome as shown in the circuit of FIG. 2, by providing an additional capacitor.

Figure 2:
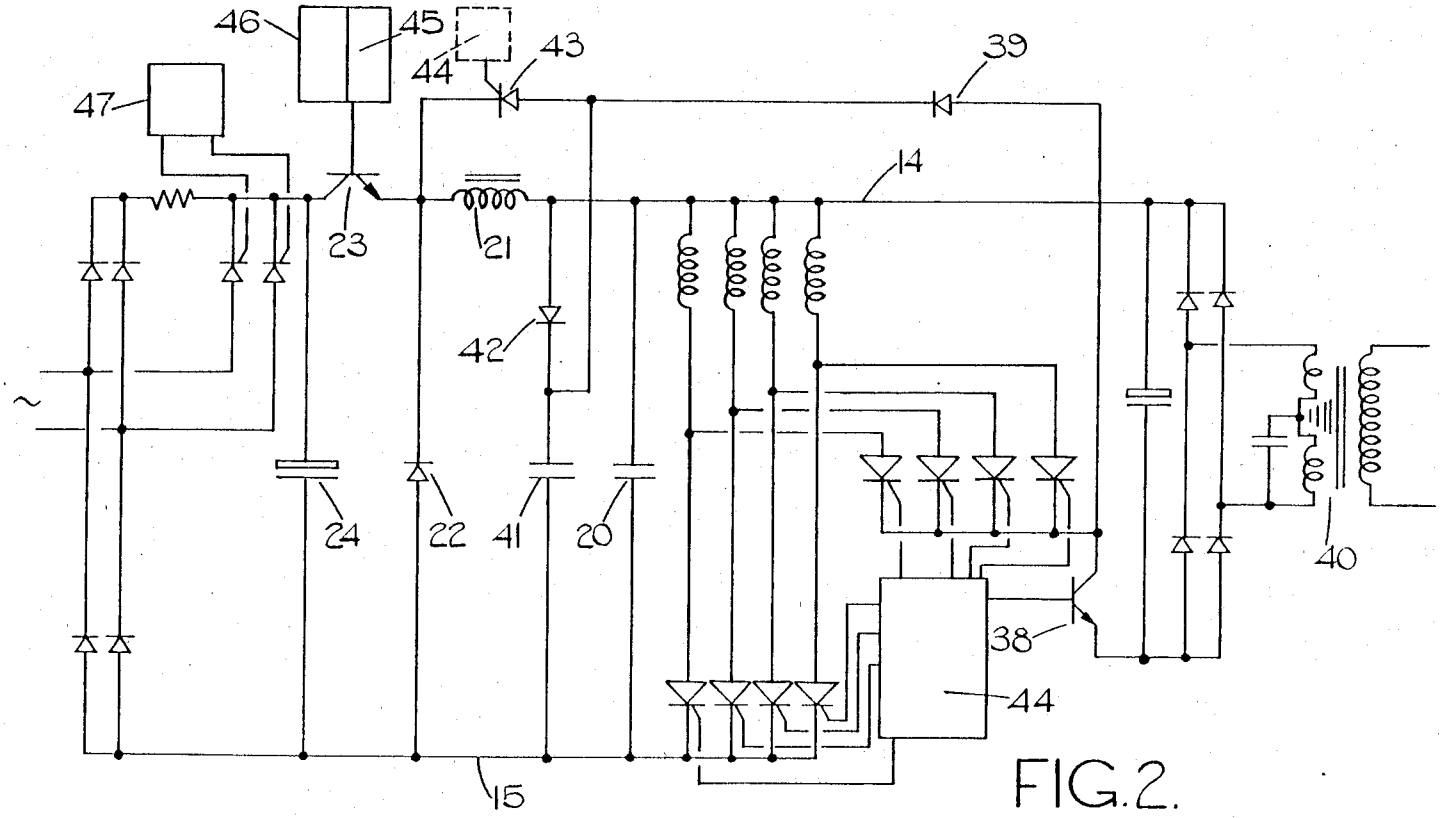
FIG. 2 shows a modified form of the circuit of FIG. 1.

Referring to FIG. 2, components which have the same duty as those of FIG. 1, are either not provided with a reference numeral or are assigned the same reference numerals as used in FIG. 1. It will be observed in FIG. 2 that the transformer 31 has been replaced by a constant voltage transformer which is referenced 40. The auto-transformer discussed previously for supplying the power required to charge the capacitor 24 is not shown. The most important modification to the circuit is the additional capacitor 41 one plate of which is connected to the supply line 15, and the other plate of which is connected to the cathode of the diode 39. Moreover, a further diode 42 is provided, this having its anode connected to the supply line 14 and its cathode to the capacitor 41. A further circuit component is a thyristor 43 and the anode of the thyristor is connected to the cathode of the diode 39, while the cathode of the thyristor is connected to the emitter of transistor 23.

In operation, during the initial charging of the capacitor 20, the capacitor 41 is also charged by way of the diode 42 to approximately the aforesaid predetermined voltage. When one of the thyristors is fired to discharge the capacitor 20, the diode 42 prevents discharge of the capacitor 41 and the cycle of operation proceeds as described. When the transistor 38 is rendered non-conductive to de-energise the previously energised actuator, the current resulting from the collapse of flux in the actuator flows in a circuit including the capacitor 41 instead of as in the example of FIG. 1, the capacitor 24. The capacitor 41 is charged to a predetermined voltage and hence variation of the supply voltage will have no influence upon the rate of decay of flux in the actuator. The thyristor 43 is conveniently fired just before charging of the capacitor 20 and the purpose of this is to equalise the voltages on the capacitors 41 and 20.

Figure 3:
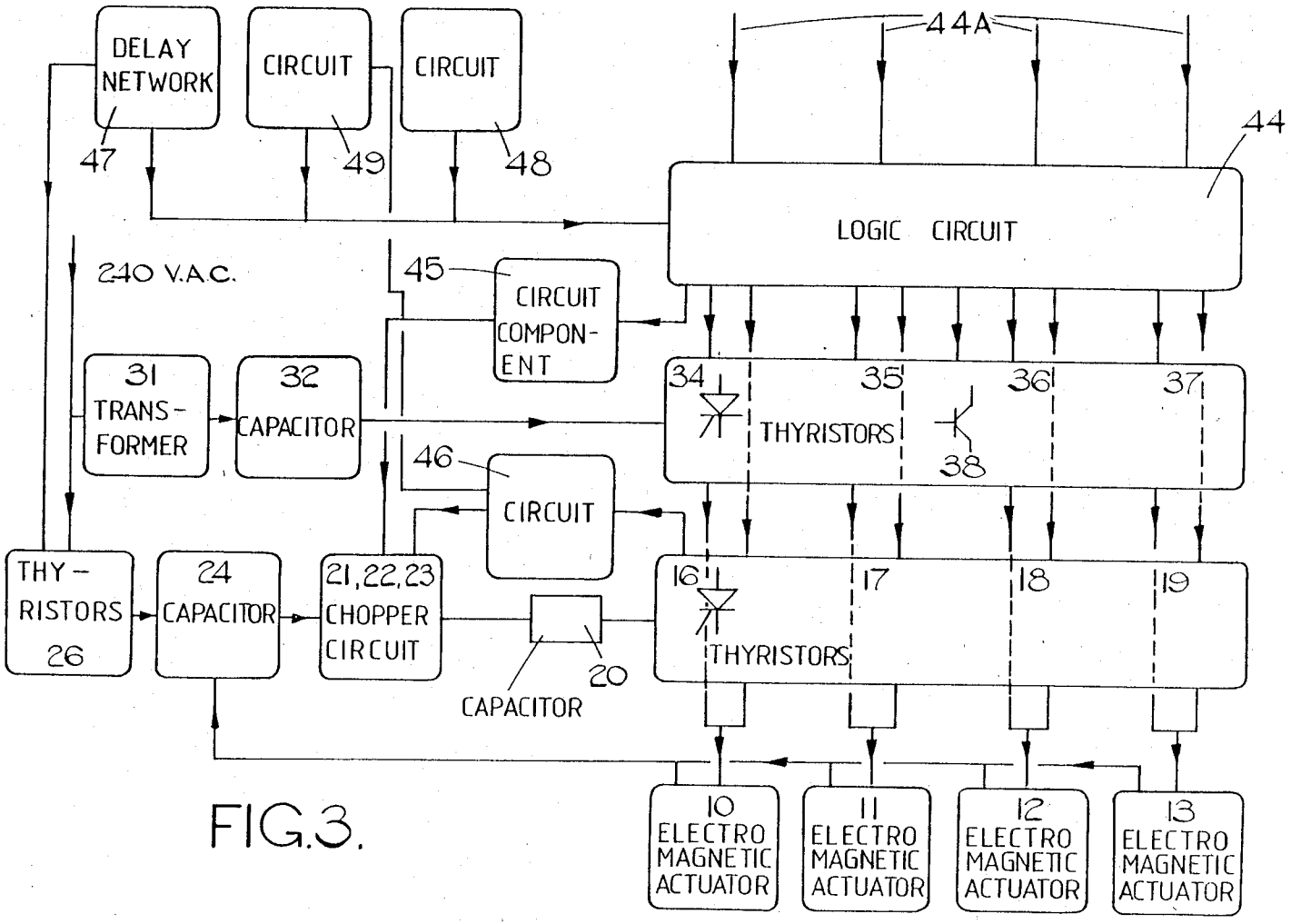
FIG. 3 is a block diagram of the power supply together with associated circuits.

Referring to FIG. 3, this shows the overall power circuit for controlling the actuators and wherever possible, the circuit components within the various blocks have been identified with reference to the numbers used in FIG. 1. Control pulses from a governor arrangement are supplied through inputs 44A to a logic circuit which is indicated at 44 and this supplies control pulses to the energising thyristors 16, 17, 18 and 19 and also to the thyristors 34, 35, 36, 37 and the transistor 38 associated with the supply of holding current. It is essential to ensure that the chopper circuit is inoperative during the supply of current to the actuators and during the collapse of current therein. A circuit component indicated at 45 is therefore provided to control the operation of the transistor 23. In addition, the transistor 23 is controlled by a circuit indicated at 46 which measures the voltage across the capacitor 20.

As previously stated, the capacitor 24 is initially charged by way of the resistor 30, and the thyristors 26 are controlled by a delay network 47 which also supplies a signal to the logic unit 44 to prevent control pulses being supplied to the various thyristors until the initial delay period has passed. In addition, a circuit 48 is provided which prevents operation of the logic circuit if the supply voltage should fall below a predetermined value. Finally, a circuit 49 is provided which again prevents operation of the logic circuit in the event that for some reason or other, one of the thyristors 16-19 should remain in a conducting state at the end of a cycle of operation. In this situation the capacitor 20 will be fully discharged and when the transistor 23 is rendered conductive, the current flowing through the transistor and the inductor will flow into the winding of the respective actuator. A very low voltage will therefore be detected by the circuit 46 and this is used in the circuit 49, to inhibit further operation of the logic circuit. The circuit 49 resets after a delay period so that a further attempt at normal operation can take place.

We claim:

1. A power circuit for an electromagnetic actuator comprising a first capacitor, a second capacitor, means for charging said second capacitor from a source of electric supply, a charging circuit through which said first capacitor can be charged from the second capacitor, said charging circuit comprising a chopper circuit including an inductor, a transistor having its collector emitter path connected in series with the inductor and a first diode connected in a series circuit including said inductor and said first capacitor, a first unidirectional switch means which when closed connects the actuator in circuit with said first capacitor thereby to cause a high initial current flow in the winding of the actuator, a low voltage source of supply, a second unidirectional switch means operable to connect said low voltage source of supply in circuit with said winding. said second unidirectional switch means being operable to deliver a holding current into the winding when said first capacitor has discharged to approximately the voltage of said low voltage source, means responsive to the voltage across the first capacitor for controlling the conduction of said transistor, a third capacitor, a second diode connected in series with said third capacitor, said third capacitor and second diode being connected in parallel with said first capacitor and a third diode connected to said third capacitor and through which energy stored in the winding of the actuator can be transferred to the third capacitor when said second unidirectional means is opened to de-energize the actutor.

2. A power circuit according to claim 1 including switch means operable to equalize the voltages on the first and third capacitors prior to charging the capacitors.

3. A power circuit according to claim 1 in which said first and second unidirectional further switch means comprise thyristors, said second unidirectional switch means including a transistor having its emitter collector circuit connected in series with the thyristor.

4. A power circuit according to claim 1 in which said low voltage source of supply includes a constant voltage transformer.

* * * * *